United States Patent [19]

Hatz et al.

[11] Patent Number: 4,510,897

[45] Date of Patent: Apr. 16, 1985

[54] MECHANISM FOR ACTUATING THE VALVE ROCKERS OF AN INTERNAL COMBUSTION ENGINE

[75] Inventors: Ernst Hatz, Ruhstorf; Erich Absenger, Passau, both of Fed. Rep. of Germany

[73] Assignee: Motorenfabrik Hatz GmbH & Co. KG, Ruhstorf, Fed. Rep. of Germany

[21] Appl. No.: 462,298

[22] Filed: Jan. 31, 1983

[30] Foreign Application Priority Data

Jun. 4, 1982 [DE] Fed. Rep. of Germany ..... 3221134
Nov. 24, 1982 [DE] Fed. Rep. of Germany ..... 3243509

[51] Int. Cl.[3] ..... F01L 1/46
[52] U.S. Cl. ..... 123/90.48
[58] Field of Search ..... 123/90.23, 90.22, 90.40, 123/90.16, 90.39, 182, 90.48, 90.17; 74/567, 569, 53, 54

[56] References Cited

U.S. PATENT DOCUMENTS

| | | | |
|---|---|---|---|
| 1,459,193 | 6/1923 | Bugatti | 123/90.48 |
| 3,046,961 | 7/1962 | Dolza | 123/90.23 |
| 3,755,745 | 5/1973 | Hatz | 123/182 |
| 3,757,749 | 9/1973 | Hatz | 123/90.23 |
| 3,878,822 | 4/1975 | Beal | 123/90.16 |
| 4,069,724 | 1/1978 | Sobotta | 74/54 |
| 4,261,307 | 4/1981 | Oldberg | 123/90.17 |

FOREIGN PATENT DOCUMENTS

| | | | |
|---|---|---|---|
| 951601 | 10/1956 | Fed. Rep. of Germany | 123/90.48 |
| 1950041 | 4/1970 | Fed. Rep. of Germany | 123/90.48 |
| 936497 | 7/1948 | France . | |
| 152314 | 1/1922 | United Kingdom | 123/90.48 |

*Primary Examiner*—William R. Cline
*Assistant Examiner*—Peggy A. Neils
*Attorney, Agent, or Firm*—Flynn, Thiel, Boutell & Tanis

[57] ABSTRACT

A mechanism for actuating valves of an internal combustion engine includes a rotatably supported shaft having a cam surface thereon and a movably supported cam follower slidably engaging the cam surface at a first location. A second cam follower member slidably engages the cam surface at one of a second and a third location thereon when the shaft is respectively rotating in one of a first direction and a direction opposite thereto, the second and third locations being spaced from the first location in opposite directions by equal angular distances. The first and second cam follower members are each operatively coupled to a respective valve of the engine.

17 Claims, 4 Drawing Figures

MECHANISM FOR ACTUATING THE VALVE ROCKERS OF AN INTERNAL COMBUSTION ENGINE

FIELD OF THE INVENTION

This invention relates to a mechanism for actuating the valves of an internal combustion engine.

BACKGROUND OF THE INVENTION

In a typical internal combustion engine, rocker levers each cooperate with a respective valve and with a respective push rod which, during axial movement, brings about a movement of the valve against the urging of a closure spring. Each such push rod is moved by a driving cam carried by a control shaft and by a double-armed intermediate lever, one arm of which engages the push rod and the other arm of which is engaged by the driving cam. The point of engagement of a first intermediate lever with the periphery of the driving cam is offset relative to the point of engagement of a second intermediate lever therewith by a specific angular amount when the control shaft is arranged to rotate in one direction.

Actuating the inlet and exhaust valves in an internal combustion engine with two rocker levers operated in common by a driving cam of a control shaft is inexpensive and is economical in space. However, some applications require that the engine crankshaft rotate in one direction, while other applications require that the crankshaft rotate in the opposite direction. Rather than manufacturing two entirely different engines for the two types of applications, it is desirable that a single basic engine be manufactured and be capable of adaptation for use in either type of application. If, however, the direction of shaft rotation is to be variable in the same type of engine (counterclockwise rotation or clockwise rotation), there are difficulties because, in a valve actuating arrangement of the type mentioned, the ducts associated with the valves (the inlet duct and the exhaust duct) are of different shape and therefore are not readily functionally interchangeable when the direction of rotation is reversed. This results in poor loading, performance and so on when there is a reversal of a rotational direction. Moreover, in such instances, the positions of the air filter, the exhaust conduit and so on are dependent on the direction of rotation, as a result of which troublesome mechanical alterations are needed for a change from one direction of shaft rotation to the other.

It is an object of the present invention to overcome these drawbacks and provide a mechanism for actuating the valves of an internal combustion engine which facilitates a changeover from one direction of rotation of the crankshaft to the other with a minimum expenditure of resources and without disadvantages in output resulting from the changeover.

SUMMARY OF THE INVENTION

This object is met in accordance with the present invention by the fact that, for operating conditions when the control shaft is turned in a direction opposite that mentioned, in place of the first intermediate lever an alternate intermediate lever is provided to operate the associated valve-rocking lever through an alternate push rod, the pivot axis of this alternate intermediate lever being offset from the pivot axes of the other two intermediate levers such that the point of contact of the alternate intermediate lever with the driving cam is offset relative to the point of contact of the second intermediate lever therewith by the same specific angular amount, but in the opposite direction.

In this way, in order to facilitate a changeover of the internal combustion engine from crankshaft rotation in one direction to rotation in the opposite direction, it is only necessary to respectively replace an intermediate lever and its push rod with an alternate intermediate lever and an alternate push rod. The remaining parts of the internal combustion engine can remain unchanged, because the functions of the two valves are not changed, even when there is an alteration in the direction of rotation.

In the preferred embodiment of the invention, the arrangement is such that the pivot axes of the first and second intermediate levers are disposed about the driving cam of the control shaft, while the pivot axis of the alternate intermediate lever is disposed below this driving cam.

BRIEF DESCRIPTION OF THE DRAWINGS

An embodiment of the invention is described hereinafter in connection with the accompanying drawing, in which.

DETAILED DESCRIPTION

In internal combustion engines, it is common to locate the inlet and exhaust valves in the cylinder head of the engine and to keep them closed by associated valve closure springs. A double-armed rocker lever is typically associated with each valve and, when the machine is in operation, opens the valve against the spring force during each operational cycle of the engine. The rocker lever is moved by a push rod, to which axial movement is in turn imparted by a control shaft having a driving cam and an intermediate lever. The control shaft is operatively driven by the engine crankshaft. Valve actuation in this manner is known, for example as disclosed in U.S. Pat. No. 3,735,745, the disclosure of which is incorporated herein by reference. Therefore, in the present application, only the engine elements which are important to an understanding of the invention are illustrated and described in detail below.

Figure 1:
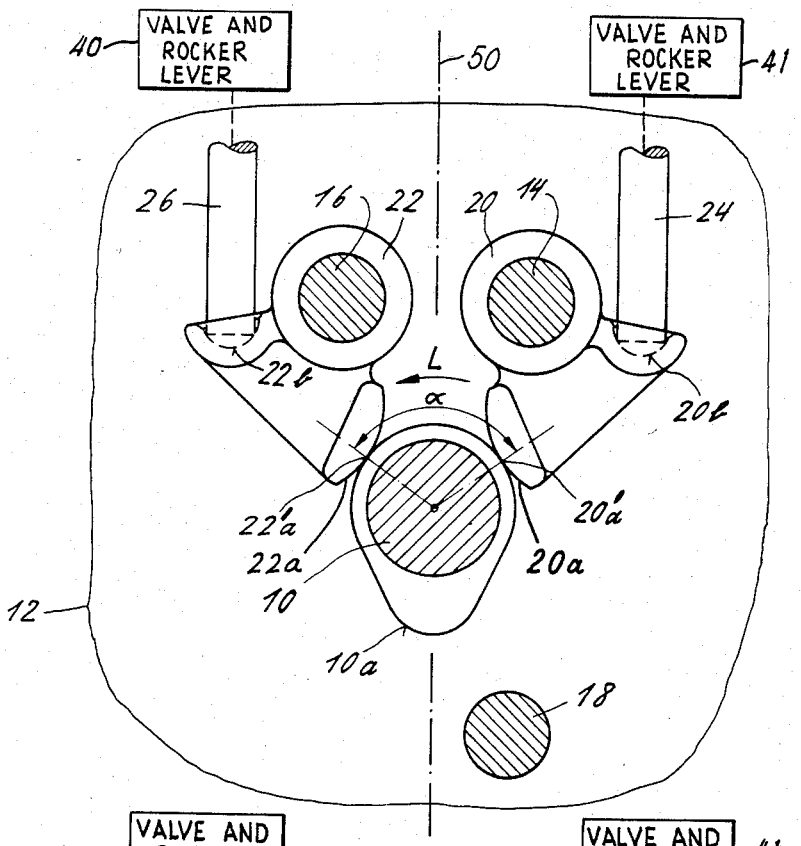
FIG. 1 is a fragmentary sectional view of a first arrangement of an internal combustion engine valve actuating mechanism which is used when a control shaft rotates in a first direction (counterclockwise)

FIG. 1 shows the valve actuating mechanism arranged for normal operation, namely for counterclockwise rotation (direction L) of the camshaft or control shaft 10. This shaft is equipped with a cam 10*a* and is rotatably supported by a part 12 of the engine housing. Provided on the same part of the housing are two horizontally spaced pivot pins 14 and 16 which are disposed vertically above the control shaft 10, and a third pivot pin 18 disposed vertically below the shaft 10.

As evident from FIG. 1, pivot pins 14, 16 and 18 are parallel to, are spaced by approximately equal radial distances from, and are located at angularly spaced locations about the control shaft 10. Pivot pins 14 and 16 are both located on one side of the shaft 10, namely thereabove, and the pivot pin 18 is located on the opposite side of the shaft 10, or in other words therebelow. The pivot pins 14 and 16 are located symmetrically on opposite sides of an imaginary plane 50 which contains the axis of the shaft 10 and which extends intermediate two push rods 24 and 26 parallel thereto. The pivot pin 18 is located on the same side of the plane 50 as the pivot pin 14, but is spaced from the pin 14 and is slightly closer to the plane 50 than the pin 14.

Intermediate or cam follower levers 20 and 22 are rotatably supported by the pivot pins 14 and 16, respectively. Each intermediate lever 20 and 22 has a respective arcuate contact surface 20*a* and 22*a* which bears against the periphery 10*a* of the control shaft 10 and slides thereon. In addition, each intermediate lever 20 and 22 has a respective upwardly open recess 20*b* and 22*b* in which one end of a respective push rod 24 and 26 is disposed. The two intermediate levers 20 and 22 are arranged so that their respective points of contact 20*a*' and 22*a*' with the periphery of the control shaft 10 are angularly spaced about the axis of the control shaft 10 by an angle $\alpha$. The angle $\alpha$ in the embodiment of FIG. 1 is approximately 110°.

The levers 20 and 22 are identical but are arranged with opposite orientations on the pivot pins 14 and 16.

The intermediate lever 20 and push rod 24 are used to operate the conventional rocker lever and exhaust valve arrangement 40 of the engine, and the intermediate lever 22 and push rod 26 are used to operate the conventional rocker lever and inlet valve arrangement 41. During the rotation of the control shaft 10 from its FIG. 1 position in the direction L (counterclockwise rotation) the cam 10*a* imparts an opening movement to the exhaust valve through the elements 20 and 24. As soon as the camshaft 10 has turned sufficiently for the contact surface 20*a* to slide over the cam 10*a*, the exhaust valve is returned to its closed position by the urging of its closure spring.

If the control shaft 10 continues counterclockwise through the angle $\alpha$, the contact surface 22*a* of the intermediate lever 22 coacts with the cam 10*a* and an opening and closing of the inlet valve is effected in a similar fashion by means of the elements 22 and 26.

Figure 2:
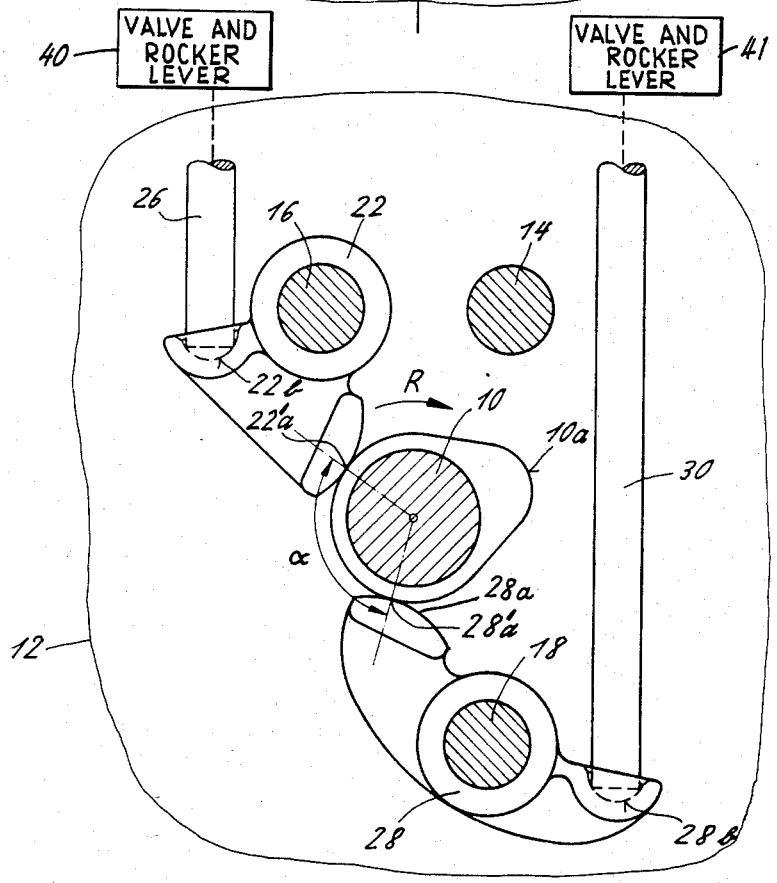
FIG. 2 is a view similar to FIG. 1 and illustrates a second arrangement of the actuating mechanism which is used when the control shaft rotates in the opposite direction (clockwise).

When in contrast the internal combustion engine concerned is to be used for other purposes which require that its control shaft 10 to perform a clockwise rotation instead of a counterclockwise rotation (as in FIG. 1), the valve actuating mechanism is arranged as shown in FIG. 2. The intermediate lever 22 and its push rod 26 are again used in this case and control the inlet valve. The intermediate lever 20 and push bar 24 are in contrast omitted and replaced by an alternate intermediate lever 28 rotatably supported by the third pivot pin 18 and by an alternate push bar 30. The contact surface 28*a* of the intermediate lever 28 engages the shaft 10 at a point 28*a*' offset by the angle $\alpha$ from the point at which the contact surface 22*a* of the intermediate lever 22 engages the shaft 10, but in an opposite direction from the point at which the contact surface 20*a* of the intermediate lever 20 engaged the shaft 10 in FIG. 1. A recess 28*b* in the intermediate lever 28 is arranged so that the push rod 30 is the same horizontal distance from the control shaft 10 as the push rod 24 was in FIG. 1, but the push rod 30 is made appropriately longer then the rod 24.

In the arrangement according to FIG. 2, clockwise rotation of the control shaft 10 and cam 10*a* first causes the exhaust valve, by means of the elements 28 and 30, to carry out an opening and closing movement. Then, after turning through the angle $\alpha$, the control cam 10*a* operates the elements 22 and 26, as a result of which the inlet valve carries out an opening and closing movement. With the arrangement of the valve actuating mechanism shown in FIG. 2 (clockwise shaft rotation), the valves and other parts of the engine have the same function as in the arrangement of FIG. 1 (counterclockwise rotation). Thus, to adapt the internal combustion engine from rotary operation in one direction to operation in the opposite direction, it is only necessary to replace one intermediate lever and one push rod with an alternate intermediate lever and an alternate push rod. In addition, the angular position of the control shaft 10 has to be repositioned relative to the engine crankshaft so that the driving cam 10*a*, as illustrated, is changed from the FIG. 1 position to the FIG. 2 position, so that the valve opening and closing times with respect to crankshaft movement will be the same in both rotational directions.

Figure 3:
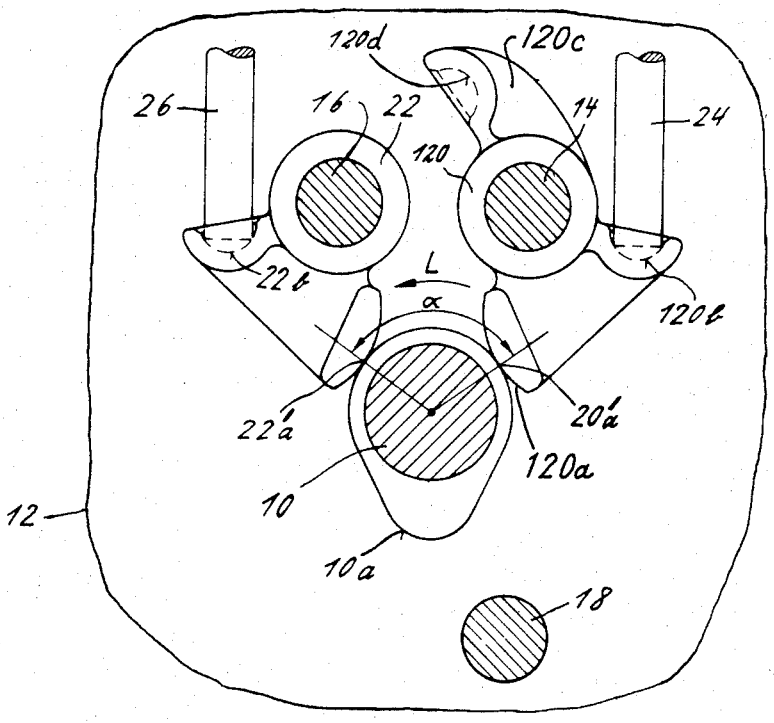
FIGS. 3 and 4 are views similar to FIGS. 1 and 2, respectively, of two further, associated embodiments of the invention.
Figure 4:
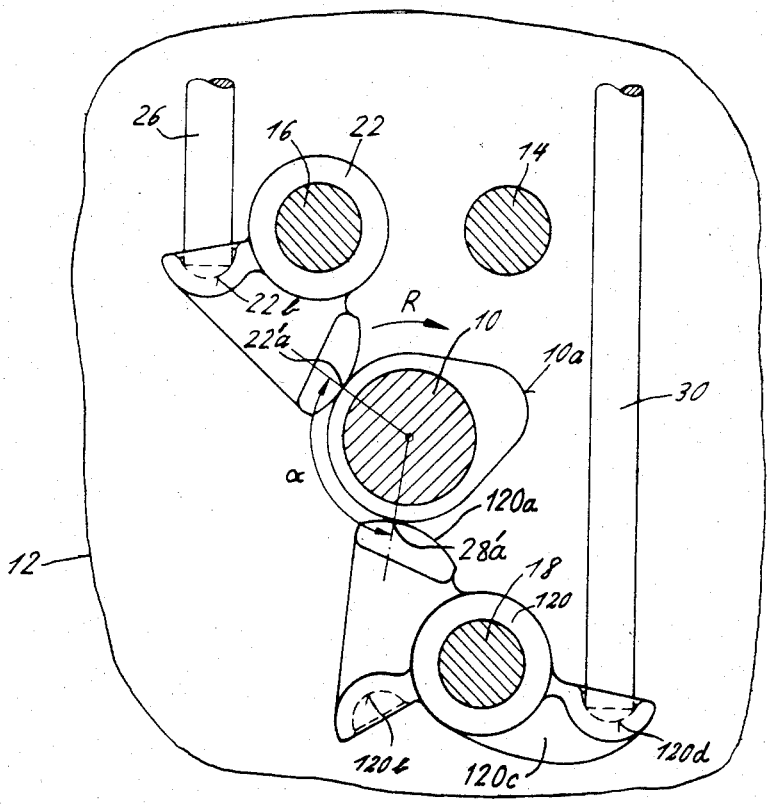

The embodiment of FIG. 3 is substantially identical to the embodiment of FIG. 1, except for the intermediate lever 120 which is pivotally supported on the pivot pin 14. The lever 120 is substantially identical to the lever 20 of FIG. 1, except that it has a further outwardly projecting arm 120*c* with a recess 120*d* near the end thereof. When the shaft 10 is to rotate counterclockwise, the lever 120 is supported on pivot pin 14 and the lower end of push rod 24 is disposed in the recess 120*b*, as shown in FIG. 3. The embodiment of FIG. 4 differs from the embodiment of FIG. 3 in that the shaft 10 rotates clockwise, push rod 30 has been substituted for push rod 24, the lever 120 is pivotally supported on pivot pin 18, and the lower end of push rod 30 is disposed in the recess 120*d*. Thus, whereas separate levers 20 and 28 are respectively required for configuring the embodiments of FIGS. 1 and 2, only a single lever 120 is necessary for configuring the embodiments of FIGS. 3 and 4. The embodiments of FIGS. 3 and 4 operate in a manner identical to that described above for FIGS. 1 and 2, respectively.

The shaft 10 is preferably coupled to the engine crankshaft in a conventional manner by the provision of gears on each shaft which mesh with each other. Thus, the adjustment of the shaft 10 can be effected by disengaging these two gears, angularly repositioning the shaft 10 relative to the crankshaft and then reengaging the gears.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are described as follows:

1. A mechanism for actuating first and second valves of an internal combustion engine, comprising: a rotatably supported shaft having a cam surface thereon; first, second and third cam follower member support means provided in the region of said shaft; a first cam follower member movably supported by said first cam follower member support means and slidably engaging said cam surface on said shaft at a first location; a second cam follower member movably supported by one of said second and third cam follower member support means and slidably engaging said cam surface on said shaft at one of a second location and a third location, respectively, said second location being spaced a predetermined angular distance from said first location in a first direction and said third location being spaced said predetermined angular distance from said first location in a second direction opposite said first direction; and valve actuating means operatively coupled to said first and second cam follower members and said first and second valves for effecting movement of said first and second valves in response to movement of said first and second cam follower members, respectively.

2. The mechanism according to claim 1, wherein said first, second and third cam follower member support means respectively include first, second and third pivot pins which are parallel to, are radially spaced from, and are provided at angularly spaced locations about said shaft, said first cam follower member being pivotally supported on said first pivot pin and said second cam follower member being pivotally supported on one of said second and third pivot pins.

3. The mechanism according to claim 2, wherein said valve actuating means includes two elongate push rods which are each supported for axial movement, one end of each said push rod being operatively coupled to a respective one of said first and second cam follower members, and wherein said valve actuating means includes means operatively coupling the other end of each said push rod to a respective one of said first and second valves.

4. The mechanism according to claim 2, wherein said shaft rotates about an axis of rotation, wherein said first and second pivot pins are symmetrically disposed on opposite sides of an imaginary plane which contains said axis of rotation of said shaft, and wherein said third pivot pin is located on the same side of said imaginary plane as said second pivot pin and is slightly closer to said imaginary plane than said second pivot pin.

5. The mechanism according to claim 4, wherein said first, second and third pivot pins are each spaced approximately the same radial distance from said shaft.

6. The mechanism according to claim 1, wherein said second cam follower member is movably supported by said second cam follower member support means, and wherein said shaft rotates in said second direction.

7. The mechanism according to claim 1, wherein said second cam follower member is movably supported by said third cam follower member support means, and wherein said shaft rotates in said first direction.

8. The mechanism according to claim 1, wherein said predetermined angular distance is approximately 110°.

9. A mechanism for actuating first and second valves of an internal combustion engine, comprising: a rotatably supported shaft having a cam surface thereon; a first cam follower member; first means for movably supporting said first cam follower member so that it slidably engages said cam surface at a first location; a second cam follower member; second means for movably supporting said second cam follower member in first and second orientations in which said second cam follower member slidably engages said cam surface at second and third locations, respectively, said second location being spaced a predetermined angular distance from said first location in one direction and said third location being spaced said predetermined angular distance from said first location in a direction opposite said one direction, and said second cam follower member having a selected one of said first and second orientations; and means operatively coupled to said first and second cam follower members and said first and second valves for effecting movement of said first and second valves in response to movement of said first and second cam follower members, respectively.

10. A mechanism for actuating two valves of an internal combustion engine, comprising: two axially movably supported push rods; two movably supported rocker levers, each said rocker lever cooperating at one end with the associated valve and at the other end with a respective said push rod which, through its axial movement, effects movement of the associated valve; a rotatably supported shaft having a cam thereon; two pivotally supported intermediate levers, said push rods each being operatively coupled to and moved by a respective one of said intermediate levers, pivotal movement of said intermediate levers being effected by said cam on said shaft; and a first pivot pin, a second pivot pin and a third pivot pin arranged at angularly spaced locations about said control shaft and each adapted to pivotally support one of said intermediate levers, the axis of each said pivot pin being substantially parallel to the axis of said shaft, said first and second pivot pins each being disposed approximately on one side of said shaft and being arranged symmetrically on opposite sides of a plane which contains the axis of said control shaft and which extends between said push rods, said third pivot pin being disposed on a side of said shaft opposite from said first and second pivot pins; wherein the engine is assembled in one of a first configuration and a second configuration; wherein in said first configuration said shaft rotates in a first direction, said first pivot pin pivotally supports one of said intermediate levers, and said second pivot pin pivotally supports the other of said intermediate levers, the point of engagement with said cam of said intermediate lever supported on said second pivot pin being spaced a predetermined angular distance in a second direction opposite said first direction from the point of engagement with said cam of said intermediate lever supported on said first pivot pin; and wherein in said second configuration said shaft rotates in said second direction, said first pivot pin pivotally supports one of said intermediate levers, and said third pivot pin pivotally supports the other of said intermediate levers, the point of engagement with said cam of said intermediate lever supported on said third pivot pin being spaced by said predetermined angular distance in said first direction from the point of engagement with said cam of said intermediate lever supported on said first pivot pin.

11. The mechanism according to claim 10, wherein said shaft extends generally horizontally, and wherein said first and second pivot pins are disposed above said cam on said shaft and said third pivot pin is disposed below said cam.

12. The mechanism according to claim 10, wherein in said first configuration, said intermediate lever supported on said second pivot pin is identical to said intermediate lever supported on said first pivot pin but is oriented in a mirror-image manner about said plane with respect thereto.

13. The mechanism according to claim 10, wherein said intermediate lever supported on said first pivot pin has means defining a recess therein which receives an end of the associated push rod, and wherein said intermediate lever supported on said second pivot pin in said first configuration has means defining two recesses therein which can each receive an end of the associated push rod.

14. The mechanism according to claim 10, wherein in said second configuration, said intermediate lever supported on said third pivot pin is of different shape than said intermediate lever supported on said first first pivot pin.

15. The mechanism according to claim 14, wherein said intermediate lever supported on said first pivot pin has means defining a recess therein which receives an end of the associated push rod, and wherein said intermediate lever supported on said third pivot pin in said second configuration has means defining two recesses therein which can each receive an end of the associated push rod.

16. The mechanism according to claim 10, wherein said intermediate levers each have means defining a recess therein which receives an adjacent end of the associated push rod.

17. The mechanism according to claim 10, wherein said intermediate lever supported on said second pivot pin in said first configuration is identical to said intermediate lever supported on said third pivot pin in said second configuration.

* * * * *